United States Patent [19]

Marotto

[11] Patent Number: 4,561,684

[45] Date of Patent: Dec. 31, 1985

[54] AUTOMATIC DEADBOLT

[75] Inventor: Robert A. Marotto, Auburn, Ala.

[73] Assignee: Kysor Industrial Corporation, Cadillac, Mich.

[21] Appl. No.: 461,614

[22] Filed: Jan. 27, 1983

[51] Int. Cl.[4] ..... E05B 63/20

[52] U.S. Cl. ..... 292/150; 292/333

[58] Field of Search ..... 292/332, 333, 335, 191, 292/192, 150

[56] References Cited

U.S. PATENT DOCUMENTS

| | | | |
|---|---|---|---|
| 228,323 | 6/1880 | Crandal | 292/333 |
| 361,247 | 4/1887 | Winchester | 292/333 |
| 562,077 | 6/1896 | Hasshagen | 292/333 |
| 858,905 | 7/1907 | Passino | 70/463 |
| 887,354 | 5/1908 | Sterrett | 292/333 |
| 1,302,873 | 5/1919 | Stiff | 292/335 |
| 1,403,128 | 1/1922 | Segal . | |
| 1,816,134 | 7/1931 | Wood | 292/333 |
| 1,919,763 | 7/1933 | Allen | 292/333 |
| 2,438,346 | 3/1948 | Mooney | 292/333 |
| 4,061,383 | 12/1977 | Waldo | 292/335 |
| 4,262,504 | 4/1981 | Inoue | 292/333 X |
| 4,478,444 | 10/1984 | Kurz et al. | 292/333 |

FOREIGN PATENT DOCUMENTS

| | | | |
|---|---|---|---|
| 629235 | 4/1936 | Fed. Rep. of Germany . | |
| 1016319 | 11/1952 | France | 292/335 |
| 376968 | 7/1932 | United Kingdom . | |

*Primary Examiner*—Kenneth J. Dorner
*Assistant Examiner*—Lloyd A. Gall
*Attorney, Agent, or Firm*—Price, Heneveld, Huizenga & Cooper

[57] ABSTRACT

A deadbolt door lock assembly wherein the deadbolt is automatically mechanically actuated with door closure for security. Door closure actuates a trigger mechanism that releases a deadbolt restraining means to allow a biased deadbolt to be thrown to extended lock condition.

13 Claims, 6 Drawing Figures

AUTOMATIC DEADBOLT

BACKGROUND OF THE INVENTION

This invention relates to door lock assemblies and particularly to a door lock having a mechanically actuated automatic deadbolt lock with door closure.

Crime rate increases beginning particularly in the 1950's caused widespread adoption of deadbolts in door lock assemblies. Typically such an assembly included a latch which is depressed during closure of the door and, with substantially complete closure, extends into a recess of the door strike. Such a latch by itself is often easy to improperly depress-release by an unauthorized person, with a card-type element or even a pry bar. Also the outer knob assembly can be torqued off with a wrench to gain access to the mechanism and thereby to the room closed by the door. Deadbolts are not as susceptible to these unauthorized activities. Doors having deadbolts also typically use a latch mechanism. This is because (1) the latch holds the door snug against rattling whereas the deadbolt by necessity must have clearance between it and the stroke plate recess edges (but because of that clearance, the door can rattle), and (2) the latch automatically holds the door shut since it is only momentarily depressed during door closure from its normally extended condition and then extends into a door strike recess when the door is fully closed.

Except in rare devices where the deadbolt is operated by an electrical solenoid, the deadbolt, to be effective, must be manually thrown by a person inside the room or building, or if the deadbolt is actuable by an external key, the person leaving the room or building must purposely engage the deadbolt by a key as the person leaves. However, if a person forgets to so actuate the deadbolt, either manually with an inner hand turn when inside, or by a key when outside, an intruder need only inactivate the latch mechanism in order to gain unauthorized entry. Motel and hotel rooms often do not even have a key actuated deadbolt and thus are particularly susceptible to unauthorized entry and theft when the person is not in the room.

In recent years, mechanisms such as that in U.S. Pat. No. 3,999,789 were developed to enable retraction, i.e. inactivation, of the deadbolt simultaneously with the latch for quick release even under panic exit conditions. But to lock the door still required manual actuation of the deadbolt with the inner hand turn or a key on the outside.

SUMMARY OF THE INVENTION

A primary object of this invention is to provide a deadbolt lock which is automatically actuated with closure of the door, the deadbolt being mechanically actuated to the extended lock position. The deadbolt in its retracted position is spring-biased toward the extended lock position, but is retained in a cocked condition by a deadbolt restraining and releasing device which is trigger actuable to activate the deadbolt into its locked condition. The trigger mechanism has a portion that protrudes from the door to engage the door strike of the door frame upon closure of the door, thereby causing the deadbolt to be released and shifted to the locked condition.

The protruding portion of the trigger mechanism can also serve to hold the door snug against rattling.

DESCRIPTION OF THE PREFERRED EMBODIMENT

Figure 1:
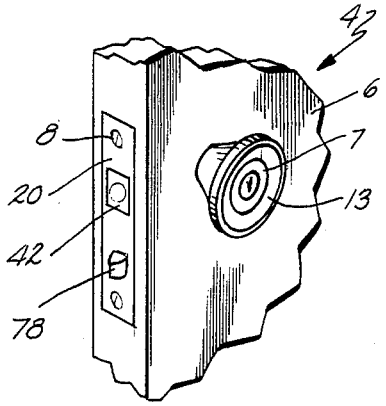
FIG. 1 is a fragmentary perspective view of a door and door lock mechanism employing this invention.

The apparatus 4 illustrated to explain this invention includes a hinged door 6 having the deadbolt lock mechanism 10 mounted in the edge portion of the door as is conventionally done, i.e. by cutting a recess in the door edge to receive the lock mechanism, and drilling a transverse hole **6*a* through the door for insertion of a swivel mechanism. When the lock mechanism is so installed, the outer surface of the front plate 20 thereof is flush with the edge surface of door 6 (FIG. 1). Extending through the transverse hole 6*a* (FIG. 3) is the spindle and door moving device 5 (FIG. 3), here shown as a circular door pull 5 (replacing the normal cylindrical spin ring). It is free to rotate around the lock cylinder 7 to thwart torqueing it with a pipe wrench. This mechanism includes a conventional key operated lock cylinder 7 at the exterior of the door, and a conventional inner hand turn 9 at the interior of the door. Lock cylinder 7 and hand turn 9 engage an elongated spindle 11** that extends through the door, between and into rotational engagement with this lock cylinder and hand turn.

Figure 3:
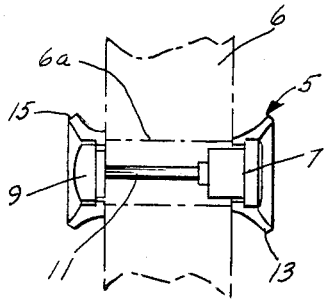
FIG. 3 is an edge elevational view of a portion of the mechanism in FIG. 1.

As will be explained further hereinafter, a latch mechanism may be used in combination with this novel deadbolt lock. However, if it is not, then door pulls can be added, e.g. at 15 around the inner turn 9 and around the key cylinder 7 as depicted in FIGS. 1 and 3, or any other equivalent.

The door lock assembly 10 has an automatic mechanical deadbolt. Deadbolt subassembly 12 protrudes into the door from the front plate subassembly, as does a trigger subassembly 16. Assembly 10 includes front plate subassembly 14 composed of a front plate 20 and a retainer plate 24. As previously noted, front plate 20 is mounted flush with the door edge, being secured thereto by screws 8 through openings 22. Spaced behind this vertical front plate is the retainer plate 24, the latter being secured to the back of face plate 20 as by staking at the periphery of openings 22. This spacing forms a slide passage as will be explained.

Matching holes or openings are provided in both front plate 20 and retainer plate 24 for extension of the deadbolt. Additional matching holes are provided in these two plates for protrusion of a portion of the trigger subassembly 16. A third opening 20' is provided in face plate 20 for protrusion of a serrated, manually operable, vertically slidable auxiliary deadbolt restrainer 28. This element 28 is held between plates 20 and 24, and is vertically movable by finger pressure.

Element 28 may be polymeric, having a diagonal lip 28' bearing against plate 24 to frictionally retain the element in any vertical position in which it is manually placed. The lower portion 28" of element 28 is optionally metallic. It is engageable in an upper slot or groove 48 of the deadbolt 42 for purposes explained more fully hereinafter.

Retained in the slide passage between the lower portions of plates 20 and 24, beneath deadbolt subassembly 12, is another deadbolt restraining plate 34. It is vertically shiftable into and out of engagement with a lower slot or groove 50 in the front end portion of the deadbolt. A generally C-shaped leaf spring 36 beneath plate 34 has one end engaging the lower edge of plate 34. Its other end abuts against the lower periphery of backplate 24. This spring biases restraining plate 34 upwardly into engagement with the cooperative groove of deadbolt 42.

Figure 6:
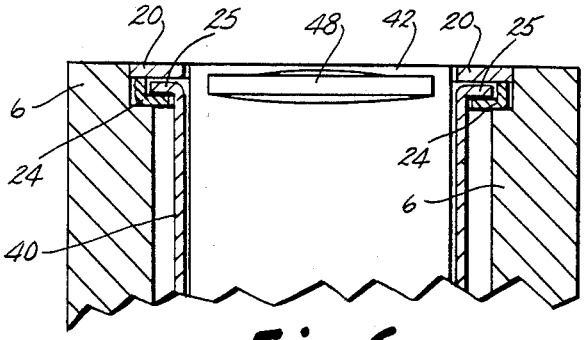
FIG. 6 is an enlarged fragmentary sectional view taken on plane VI—VI of FIG. 5.
Figure 5:
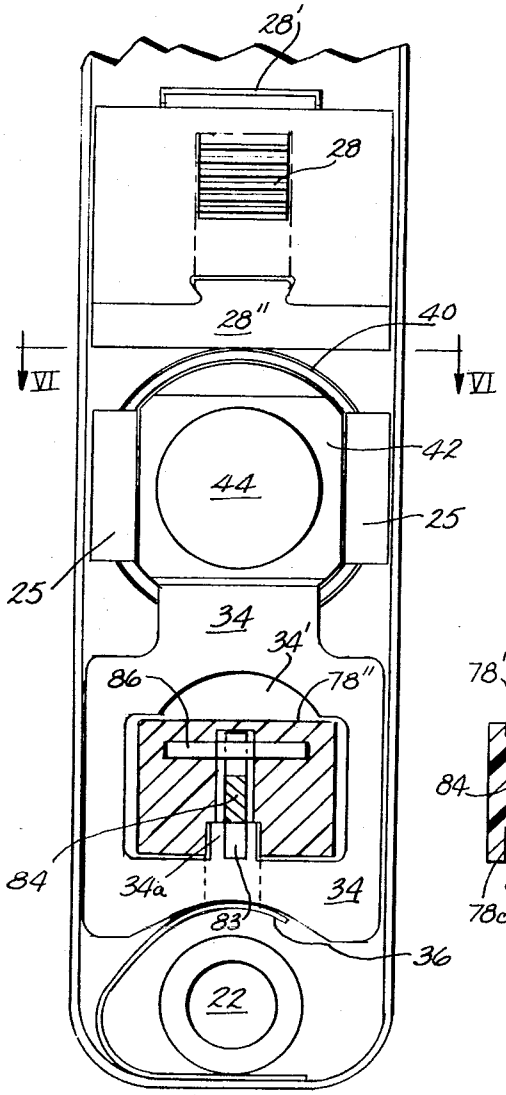
FIG. 5 is an enlarged end elevational view of the mechanism in FIG. 3, partially sectional, taken on plane V—V of FIG. 4 with the front plate removed.

Deadbolt subassembly 12 includes an outer elongated generally cylindrical housing 40 protruding into the door, normal to front plate 20. Housing 40 is retained in the door by having a pair of outwardly projecting, laterally spaced side flanges 25 (FIG. 5) that are sandwiched between front and back plates 20 and 24 (FIG. 6) which are staked together. Within this elongated housing 40 is a deadbolt 42 shiftable between the retracted unlock position inside the door as illustrated in FIG. 1, and an extended lock position protruding out of the door past front plate 20 for engagement into an elonated opening 37 in a door strike typically having a reinforcing strike plate 35 of metal and into a cooperative recess in the door frame to which the strike plate is attached by screws in conventional fashion.

Deadbolt 42 is basically cylindrical in configuration on its horizontal axis, being axially shiftable. It has an elongated hollow interior 42' in its central portion. At its front, outer axial end is a resilient polymeric, i.e. plastic or rubber bumper 44. This may be in the form of a plug snapped and held into position by a bayonet-type inner end that engages behind a cooperative shoulder inside the deadbolt. This resilient plug minimizes noise when the deadbolt strikes against the cooperative strike plate in the doorframe as the door is closed, as will be described more fully hereinafter.

Upwardly open groove 48, which is located on the top of the deadbolt near the outer end thereof, and which is horizontally elongated transverse to the axis of the deadbolt, is aligned with the manually actuated, vertically slidable deadbolt restrainer 28 when the deadbolt is in its retracted position depicted, for engageably receiving the lower portion 28" of auxiliary restrainer 28 to restrain the deadbolt until manually released. Restrainer 28 is movable basically perpendicular to the horizontal direction of movement of deadbolt 42.

Likewise, downwardly opening groove 50, which is located on the bottom of the deadbolt near the outer end thereof, and which is also horizontally elongated transverse to the axis of the deadbolt, for engageably receiving the upper end portion of deadbolt restrainer plate 34, is aligned with plate 34 when the deadbolt is retracted. Plate 34 is also movable vertically, i.e. basically perpendicular to the horizontal direction of movement of deadbolt 42. Both manual element 28 and biased plate 34 are independently capable of restraining the deadbolt from moving from its retracted position illustrated to its extended lock position. The first is manually operable and the second is automatically operable.

Within the axially elongated generally cylindrical opening 42' at the center of the deadbolt is a hardened metal pin 46 of the type conventionally used in deadbolt elements to prevent the deadbolt from being sawn in two when extended. Also in opening 42' is an elongated coil compression spring 54 abutting at its rear end against a fixed stop plate 56 and at its outer end against an enlarged portion of pin 46 to apply a biasing force to the deadbolt tending to shift the deadbolt from its retracted position depicted to its extended lock position.

The deadbolt can be manually shifted to the retracted position by a retractor bar 60. Bar 60 has an offset 60' at its forward end to engage in a cooperative recess 42*a* in the rear end portion of the deadbolt. Protruding up through opening 60" in retractor bar 60 is a radially oriented arcuately movable throw actuator arm 66 of a swivel mechanism. Specifically, this actuator 66 is attached to an arcuately movable swivel 68 which includes a configurated socket 68' for receiving an elongated, conventional, like configurated spindle 11. The spindle is normally polygonal in cross section, e.g. rectangular. Thus a person inside the room can manually operate the spindle by rotating the inner hand turn 9 to arcuately shift the swivel and throw actuator 66, thereby shifting the throw actuator from the phantom line position depicted (FIG. 4) to the solid line position depicted, and thereby retract deadbolt 42 to its recessed, retracted position behind face plate 20. Actuator 66 is preferably biased into either of these two overcenter positions depicted by a leaf spring 70 engaging a peripheral radial protrusion 66' as illustrated. One end of this spring 70 is secured by end plate 72 to housing 40.

Figure 4:
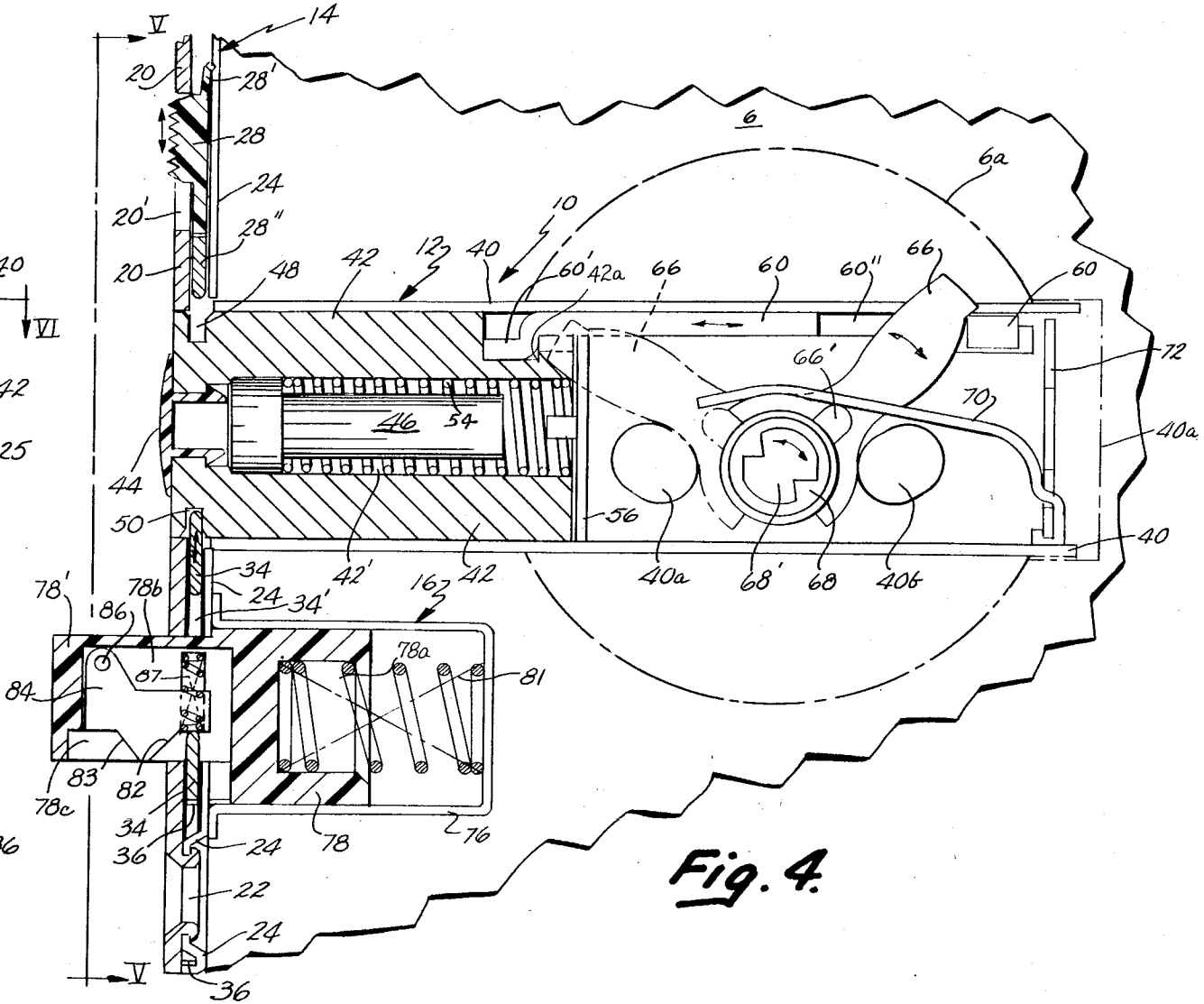
FIG. 4 is an enlarged side elevational, partially sectional view of the novel door lock mechanism.

The rear end of this housing may optionally include an end cap 40*a* shown in phantom lines in FIG. 4.

The trigger subassembly 16 is shown to include a guide housing 76 having a polymeric slide member 78 movable therein perpendicular to the vertical orientation of face plate 20, either in one direction when depressed or in the opposite return direction when extended. Integrally attached to and protruding from slide 78 is a depressible trigger protrusion or nose 78' that extends through an opening in retainer plate 24, an enlarged opening in plate 34, and through an opening in front plate 20, to protrude past the front plate for abutment with the door strike. A compression spring 81 between the rear end of housing 76 and the rear cavity 78*a* in slide 78 biases the trigger mechanism to this extended position.

Figure 2:
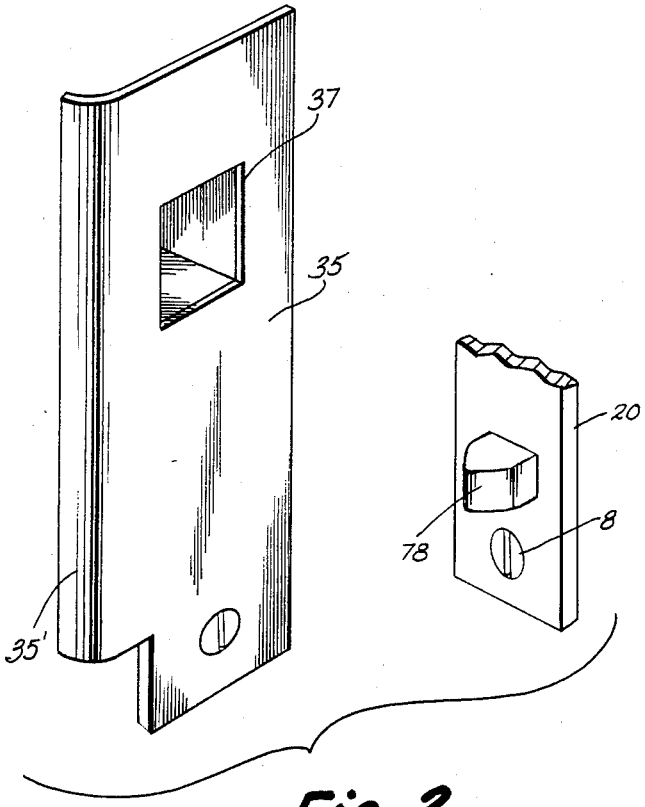
FIG. 2 is an enlarged fragmentary perspective view of a portion of the face plate of the mechanism depicted in FIG. 1, as well as the cooperative strike plate of the doorjamb.

This protrusion means 78' is tapered toward its outer end, at least on the side engaging the strike plate 35 of the door strike and optionally on both sides as depicted in FIGS. 1 and 2. Abutment of the door strike by this tapered nose causes the trigger to be forced into the door when the door is being closed. This occurs because the tapered nose is cammed into the door against the bias of its spring 81 as by the camming action of the conventional curved flange 35' of strike plate 35, or the equivalent, against the tapered protrusion.

Within this movable trigger slide and nose is an internal clutch means. It has a cam formed by a diagonal cam surface 82 to depressibly shift deadbolt restraining plate 34 down out of engagement with the deadbolt, and specifically groove 50 thereof, when protrusion 78' is depressed axially horizontally inwardly against the bias of spring 81 into housing 76, i.e. to a position generally flush with front plate 20. This cam surface 82 is on a pivotal element 84 mounted on pivot pin 86 within recess 78*b* of the trigger element. Pivotal element 84 extends into enlarged opening 34' in plate 34, and rests upon lower edge **34*a* of this opening 34'. The diagonal orientation of cam surface 82 is perpendicular to an imaginary line connecting surface 82 with the pivot axis of pin 86. Thus, with axial depression of protrusion 78' into front plate 20, element 84 will not pivot, but rather cam surface 82 will push plate 34 downwardly against the bias of C-shaped spring 36, out of engagement with deadbolt 42, for release of the deadbolt under the action of its biasing spring 54. The released deadbolt then shifts toward the extended lock position. The orientation of cam surface 82 causes this camming force to be oriented directly toward pin 86 so that element 84 does not pivot about pivot pin 86. However, when the trigger mechanism moves from its depressed condition to its extended position, such that the alternate diagonal surface 83 engages portion 34*a* of plate 34, plate 34 is not depressed, but rather, element 84 is pivoted about pin 86 until it rides over edge 34*a* and drops down to the position depicted in FIG. 4**. As noted previously, the reason for this arrangement is to prevent the trigger mechanism from releasing a retracted and restrained deadbolt when the door is opened, i.e. causing the trigger mechanism to release the deadbolt only when the door is closed.

The primary purpose of this invention is to provide an automatic mechanical deadbolt which will be thrown to locked condition when the door is closed. Specifically, when the door is closed, the abutment protrusion or nose 78' of trigger subassembly 16 engages the door strike, causing protrusion 78' to be depressed into the door against the bias of compression coil spring 81. As it is so depressed, camming surface 82 on element 84 engages edge portion **34*a* of restraining plate 34 to forcefully shift plate 34 downwardly, thereby retracting the upper end thereof out of the cooperative groove 50 in the lower portion of the outer end of deadbolt 42. This retraction of restraining plate 34 out of the deadbolt allows the cocked biasing spring 54 inside the deadbolt to advance deadbolt 42 through the opening in retainer plate 24 and front plate 20 and into engagement with the surface of the door strike, and usually the strike plate 35 mounted on the door frame. The deadbolt is still not fully extended and is still under the biasing force of spring 54. Because this deadbolt is activated with significant force under the bias of the spring, and it first strikes the strike plate surface, it preferably has the resilient bumper nose 44 to minimize noise. Complete closing of the door causes the deadbolt to ride over the strike plate and into alignment with strike opening 37** in the strike plate, allowing full extension of the deadbolt. The door is thus secure without the person having to manually throw the deadbolt.

To open the door, the deadbolt is manually retracted either by an external key in cylinder lock 7 or by a hand turn 9, either of which rotates spindle 11 in swivel socket 68' of swivel 68. This rotates the swivel actuator 66 from the phantom line position to the solid line position depicted in FIG. 4, thereby moving retractor bar 60 horizontally inwardly to draw deadbolt 42 into housing 40 against the bias of compression spring 54. As the deadbolt reaches its innermost position, C-shaped spring 36 between plates 20 and 24 biases restraining plate 34 up into lower slot 50 of deadbolt 42 to restrain the deadbolt in this retracted position. This movement of plate 34 can occur because of the recess **78*c* in the trigger, axially outwardly of the cam, i.e. clutch means. The door then may be pushed open or pulled open using pulls 13 or 15**, or any other type of knob, handle, or a door latch mechanism.

As the door clears the door frame, spring 82 again biases slide 78 and nose 78' of the trigger mechanism to the extended position depicted in FIG. 1. As it does so, surface 83 of element 84 engages edge **34*a* of element 34. However, instead of surface 83 biasing element 34 downwardly as does surface 82, element 84 merely pivots about pin 86 in an inactive condition because the engagement of surface 83 with edge 34*a* applies a force which is rotational about pin 86. Element 84 therefore simply rides up and over edge 34*a* and drops down again to the position depicted. Preferably a small spring 87 is provided to assist gravity in biasing element 84 to its lowered position depicted in FIG. 1. Hence, because element 84 serves to shift plate 34** downwardly with closure of the door but not with opening of the door, the deadbolt will be released to shift to its extended lock position with closing of the door but not with opening of the door.

If it is desired to maintain the deadbolt in retracted condition even with door closing, the auxiliary finger-operated restrained 28 can be manually shifted downwardly to engage upper groove 48 in the deadbolt. This might occur for example if a latch mechanism is used in addition to the assembly depicted. The deadbolt will then remain retracted until this auxiliary deadbolt restrainer is shifted out of engagement with the deadbolt.

The form of the invention depicted and described in detail as illustrative is the presently preferred form. However, it is possible to alter elements of the illustrative mechanism to obtain somewhat different versions of the invention. As examples, the deadbolt restraining means could engage the deadbolt in different locations than depicted, the clutch could have other movement than the pivotal one depicted, the trigger means could have a compound movement rather than the simple straight line movement shown, to name a few. Thus, the invention is not intended to be limited to all the illustrative details set forth, but only by the scope of the claims to follow and the reasonable equivalents to the claimed apparatus.

The embodiments of the invention in which an exclusive property or privilege is claimed are defined as follows:

1. A door lock assembly comprising:

a flat front plate assembly including spaced front and retainer plates defining a flat passage therebetween;

a deadbolt assembly including a tubular deadbolt housing and a deadbolt therein shiftable through said front plate assembly between an extended lock position and a retracted position, said deadbolt defining catch means generally aligned with said front plate assembly passage when said deadbolt is in said retracted position, said catch means being not aligned with said passage when said deadbolt is in said extended lock position;

means for shifting said deadbolt from said extended lock position to said retracted position;

biasing means for applying a bias on said deadbolt toward said extended lock position;

restraining means immediately behind said front plate and shiftable within said flat front plate assembly passage for shifting into engagement with said deadbolt catch means to restrain said deadbolt in said retracted position against the bias of said biasing means, and being shiftable out of engagement with said deadbolt to release said deadbolt to enable said biasing means to shift said deadbolt to said extended lock position;

and a trigger assembly including a tubular trigger housing separate from said deadbolt housing, said deadbolt and trigger housings being generally parallel, said trigger assembly extending through said front plate assembly for shifting said restraining means to disengage and release said deadbolt and thereby allow said biasing means to shift said deadbolt to said extended lock position.

2. The door lock assembly in claim 1 wherein said catch means comprises said deadbolt defining a groove, and wherein said restraining means comprises a plate.

3. The door lock assembly in claim 1 wherein said trigger assembly includes protrusion means for abutment with a door strike on a door frame to cause said trigger assembly to shift said restraining means to release said biased deadbolt to shift into said lock position.

4. The door lock assembly in claim 1 wherein said trigger assembly comprises:

(a) an abutment protrusion, (b) second biasing means biasing said abutment protrusion to a protruding condition from said front plate assembly, said abutment protrusion being depressible against the force of said second biasing means, (c) a cam supported by and movable with deprssion of said abutment protrusion, and in operative relation with said restraining means, for shifting said restraining means with depression of said abutment protrusion.

5. The door lock assembly in claim 4 wherein said cam includes means for shifting said restraining means only with closure of a door.

6. The door lock assembly in claim 4 wherein said cam includes means for preventing shifting of said restraining means during extension of said depressed abutment protrusion, whereby opening of a door containing said door lock assembly will not release said deadbolt.

7. The door lock assembly in claim 6 further including means for maintaining said cam in fixed position during depression of said abutment protrusion and for shifting said cam means to an inactive condition during extension of said abutment protrusion.

8. The door lock assembly in claim 7 wherein said cam means is pivotally mounted about a pivot axis within said abutment protrusion to pivotally shift in said inactive condition during extension of said abutment protrusion, said cam means including a cam surface spaced from said pivot axis and extending generally normal to an imaginary line connecting said cam surface and said pivot axis, so as to prevent pivotal movement of said element with force at said cam surface, and said cam surface engaging said restraining means for shifting thereof with force at said cam surface against said restraining means.

9. The door lock assembly in claim 1 wherein said deadbolt includes a resilient bumper at the outer end thereof.

10. The door lock assembly in claim 1 also including an auxiliary, manually operable, deadbolt restrainer capable of securing the deadbolt in its retracted position until manually released.

11. A door lock assemby for a hinged door and cooperative with a door strike of a door frame, comprising:

a front plate assembly including a front plate;

a deadbolt assembly including a tubular deadbolt housing and a deadbolt mounted therein, said deadbolt assembly extending through said front plate for mounting in the door, said deadbolt being shiftable between a retracted nonlock position and an extended lock position, said deadbolt defining a transverse detent means located immediately behind said front plate when said deadbolt is in said nonlock position and forward of said front plate when said deadbolt is in said lock position;

manually operable means for shifting said deadbolt from said extended lock position to said retracted nonlock position;

first biasing means for applying a bias on said deadbolt toward said extended lock position;

a restraining plate parallel to and immediately behind said front plate, said restraining plate being shiftable in a direction parallel to said front plate between a first restraining position wherein said restraining plate engages said deadbolt detent means when said deadbolt is in said nonlock position and a second release position wherein said restraining plate is withdrawn from said deadbolt detent means enabling said deadbolt to travel to its lock position;

second biasing means for applying a bias on said restraining plate toward engagement with said deadbolt detent means;

a trigger assembly including a tubular trigger housing separate from said deadbolt housing, said trigger and deadbolt housings being generally parallel, said trigger assembly extending through said front plate for shifting said restraining plate when said trigger assembly is actuated, said trigger assembly including a protruding portion for engaging a door strike for actuating said trigger assembly; and a door strike including a surface to engage and depress said trigger assembly protruding portion for actuation of said trigger assembly and shifting of said deadbolt restraining plate, said door strike including an opening to receive said deadbolt when extended.

12. A door lock assembly for a door in a door frame, comprising:

a front plate for the edge of a door;

a retainer plate spaced from said front plate to define a flat slide passage therebetween;

a tubular deadbolt housing extending in from said front plate;

a deadbolt in said deadbolt housing, shiftable between a retracted position and an extended lock position protruding past said front plate, said deadbolt defining a transverse groove generally aligned with said slide passage when said deadbolt is in said retracted position and unaligned with said passage when said deadbolt is in said lock position;

first spring biasing means in said deadbolt housing for biasing said deadbolt toward said extended lock position;

deadbolt restraining means immediately behind said front plate and within said slide passage shiftable into restraining engagement with said deadbolt groove, and out of restraining engagement therewith for release of said deadbolt;

second spring biasing means within said slide passage for biasing said restraining means toward engagement with said deadbolt groove;

a trigger assembly including a tubular trigger housing separate from said deadbolt housing, said trigger and deadbolt housings being generally parallel, said trigger assembly protruding through said front plate, cooperable with said deadbolt restraining means, and depressibly shiftable in a first direction upon engagement with a door strike to shift said deadbolt restraining means out of restraining engagement with said deadbolt for releasing it and thereby allowing said spring biasing means to shift said deadbolt into said extended lock position, said trigger assembly also being shiftable in a second return direction with disengagement from the door strike, said trigger assembly including clutch means for causing said trigger assembly to shift said deadbolt restraining means only with shirting of said trigger assembly in said first direction and not in said return direction; and third spring biasing means for biasing said trigger assembly in said return direction.

13. The door lock assembly in claim 12 wherein said clutch means includes a cam surface cooperatively engageable with said deadbolt restraining means to shift it out of engagement with said deadbolt groove during depression of said trigger means.

* * * * *